United States Patent [19]

Guelli

[11] Patent Number: 4,969,216

[45] Date of Patent: Nov. 13, 1990

[54] PADDED UNDERWEAR

[76] Inventor: Alphonse A. Guelli, 1133 Landers St., Ormond Beach, Fla. 32174

[21] Appl. No.: 486,216

[22] Filed: Feb. 28, 1990

[51] Int. Cl.[5] ..... A41B 9/00; A41B 9/02

[52] U.S. Cl. ..... 2/400; 2/2; 450/98

[58] Field of Search ..... 2/400, 2, 215, 404, 2/406, 402, 403; D2/1; 450/98

[56] References Cited

U.S. PATENT DOCUMENTS

| | | | |
|---|---|---|---|
| 1,468,072 | 9/1923 | Ogle | 450/98 |
| 2,332,141 | 10/1943 | Greene | 450/98 |
| 2,807,805 | 10/1957 | Allan | 450/98 |
| 3,295,530 | 1/1967 | Mayer et al. | 450/98 |
| 3,524,448 | 8/1970 | Parco | 450/98 |
| 4,807,301 | 2/1989 | Ferber | 2/2 |

*Primary Examiner*—Werner H. Schroeder
*Assistant Examiner*—Gloria Hale
*Attorney, Agent, or Firm*—Edward M. Livingston

[57] ABSTRACT

An underwear garment for increased comfort while sitting for lengthy periods of time having a resilient cushion means secured by sewing it in the seat of the underwear. The cushion can extend into the crotch portion to provide comfort and protection to the spinal cord, especially for persons with hemorrhoids. The cushion is also sewn down the middle so that it folds with the natural line of the buttocks. The cushion means may consist of foam rubber or any cushion that allows air penetration. Although the cushioned underwear is designed primarily for comfort, the present underwear may also be worn to protect the body while playing sports without interference.

10 Claims, 1 Drawing Sheet

PADDED UNDERWEAR

BACKGROUND OF THE INVENTION

This invention relates to clothing undergarments and more particularly to underwear containing cushions or pads for comfort and safety.

Most often, when a person is required to sit for long periods of time at sporting events or other activities, particularly on hard benches, his or her posterior becomes very sore. Therefore, attending such events or activities is very discomforting, particularly for older people.

Currently, there is almost no way to avoid such discomfort, except perhaps by taking a cushion or seat with oneself when attending such events. That, too, is cumbersome and is easily forgotten. Therefore, there exists a need for an undergarment that will provide the necessary cushioning for the posterior, that is comfortable, form-fitting so it is unnoticeable and not too hot when worn.

The prior art include some undergarments with cushions therein, but none like the present invention. For instance, U.S. Pat. No. 4,807,301 by Ferber (1989) shows a wrap-around garment with pads in the hips and buttocks. Ferber's invention differs in that it's separate garment that can be worn around the person. U.S. Pat. No. 2,637,032 by Pinsuti, shows underwear with a pair of seat cushions suspended and sewn into the buttocks portion of the underwear. Pinsuti differs in that the pads are sewn into a different area and are not actually a part of the underwear itself. Other relevant prior art includes U.S. Pat. No. 4,156,294 by Horn (1979); U.S. Pat. No. 4,462,115 by Carlson, et al., 1984; U.S. Pat. No. 1,044,494 by Clarke (1912); U.S. Pat. No. 1,561,712 by Goldsmith (1925); U.S. Pat. No. 3,637,230 by Poik (1972); and U.S. Pat. No. 4,700,407 by Mattila (1987). All of these prior patents involve some form of padded undergarment, primarily for protecting a person from sports and motorcycle injuries, but none is constructed as the present invention to provide cushioning in the proper areas for sitting. Furthermore, the additions to the underwear in prior art are not incorporated into the underwear for proper fit.

SUMMARY OF THE INVENTION

The primary object of the present invention is to provide an underwear garment that removes or alleviates the discomfort caused by sitting.

Another object is to provide such an underwear garment that fits the form of the body so that it is not noticeable through outer garments.

Even another object is to provide such an undergarment that is not cumbersome and is easy to wear.

A further object is to provide such an underwear garment that is not too hot for the wearer.

An even further object of the present invention is to provide protection to the user when worn in sporting activities.

The present invention accomplishes the above and other objects by providing underwear having a waistband in front and seat portions connected by a crotch portion having cushion means in the seat portion extending from just below the waistband to the bottom of the seat and from one side of the seat to the other. The cushion means, which is secured in the underwear means preferably by of stitching around the perimeter thereof, may be foam rubber or any other material that allows air flow through so that it breathes and remains cool when worn. In order to be form-fitting, the cushion means is also stitched down the center thereof so that it conforms to the shape of the body. To provide further protection, the cushion means may extend to the crotch area of the underwear so that it also provides comfort and protection for the spinal cord of the wearer.

BRIEF DESCRIPTION OF THE DRAWINGS

The drawings used in conjunction with the description of the preferred embodiments are as follows.

DESCRIPTION OF THE PREFERRED EMBODIMENT

Figure 1:
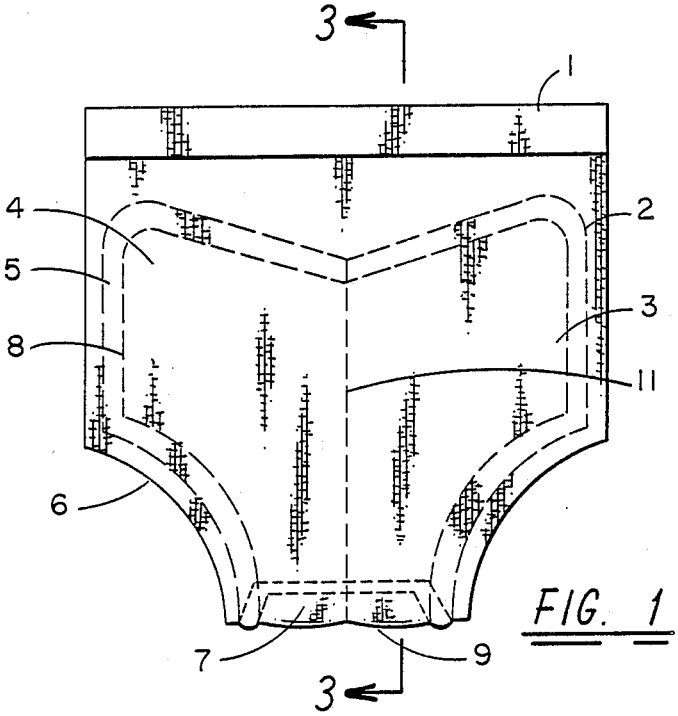
FIG. 1 is a rear plan view of the padded underwear.

Referring now to the drawings, the padded underwear which is the subject of this invention is shown having the basic components of most underwear garments, that is, a waistband 1, seat portion 3, crotch 9 and front portion 10. The underwear also has openings 6 for the insertion of the legs. As shown in the planned view, the pad or cushion means 4 may be fastened securely in the rear seat portion 3 of the underwear by sewing or stitching around its perimeter. Although only one stitch line is necessary; however, as shown the cushion means 4 is served by two sew lines—an outer sew-line 2 and an inner sew-line 8. The use of two sew lines results in two padded sections, an inner padded section 4 and an outer padded section 5. As shown, the pad may also extend under the crotch area 9 to form a crotch padded portion 7, which provides comfort and protection to the back bone or spinal cord, especially important for persons with hemorrhoids. Although not necessary to the underwear, this invention may have an additional sew- or stitch-line 11 vertically down the center thereof, to further conform it to the shape of the buttocks so that it folds with movement and is less likely to be noticeable through outer garments.

Figure 2:
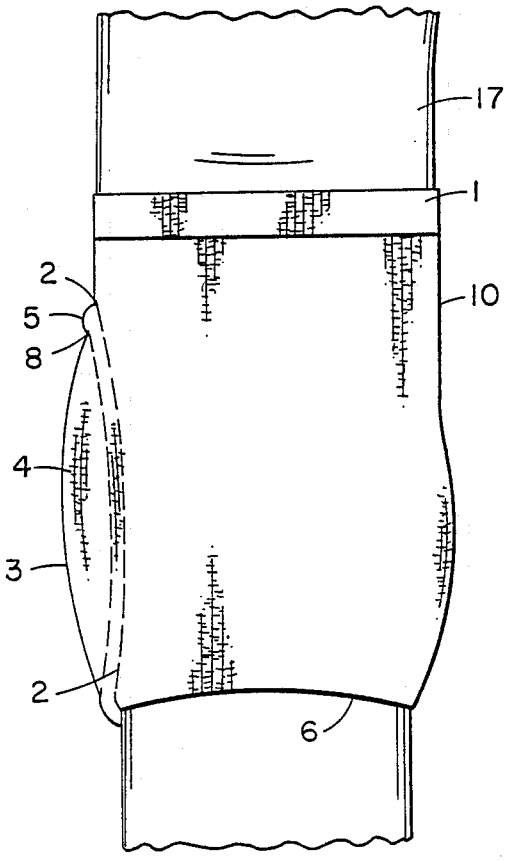
FIG. 2 is a side plan view of the padded underwear being worn.

In FIG. 2, the padded portion of the underwear is shown as it might appear in plan view when worn by a person 17. The securement of the padded portion is designed to make the cushion 14 unnoticeable when worn.

Figure 3:
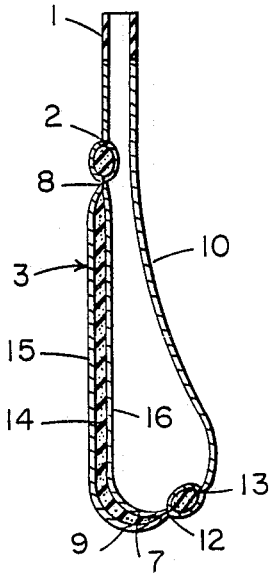
FIG. 3 is a cross-sectional view along lines 3—3 of the padded underwear of FIG. 1.

FIG. 3 shows the inner cushion portion 4 in FIG. 1 in crosssection. The cushion may consist of foam padding 14 or another substance that would allow air to penetrate through it when worn, air penetration being important to keep a person from becoming hot or sweating while wearing the underwear. The foam padding 14 would be secured to the seat portion 3 of the underwear by first placing the foam rubber padding over the seat portion 3, then placing over the foam padding an inner cloth 16 made of the same material as the overall underwear and sewing said cloth 16 around its perimeter. The inner cloth 16 would be large enough to fit around the padding's perimeter when the entire foam padding 14 is place under compression. As shown, the foam padding could also be placed in the crotch section of the underwear 9 and then sewn around its perimeter 13. Further stitching could be added at inner sew-lines 8 and 12 in order to further secure the foam padding therein. The cushion means would not interfere in any way with the front 10 the underwear or waistband 1.

Figure 4:
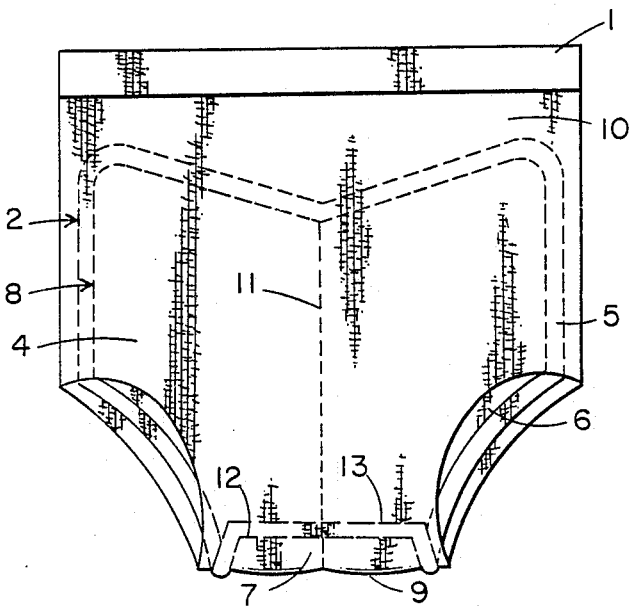
FIG. 4 is a front plan view of the padded underwear.

The final view of the invention in FIG. 4 illustrates in plan view the underwear as it might appear with the cushion means sewn in place. The cushion section 4 could be all one cushion or multiple cushions. As shown, it would be preferably one cushion which is sewn in various sections to conform to the human body. The cushion may extend from the waistband 1 to leg opening 6 and under the crotch section 9 so that it would cover the entire buttocks area. This design would provide the most comfort and protection over the entire area of the user.

As described in detail hereinabove, the present invention provides a novel and non-obvious padded underwear which will alleviate the discomfort of sitting, especially for long periods of time, and yet will be unnoticeable through the outer garments. At the same time the present invention provides comfort it would provide those wearers involved in sporting activities with important protection to a vital area of the body, the spinal cord.

Although the description above has been limited to a few preferred embodiments of the invention, it should be understood that the present invention is intended to incorporate any modifications within the scope and spirit of the claims.

Having thus described my invention, I claim:

1. An underwear garment having a waistband and front and seat portions connected by a crotch portion with leg openings comprising:

cushion means in the seat portion thereof extending from below the waistband to the bottom of the seat and leg openings, from one side of the seat portion to the other; and means for securing the cushion inside the seat portion of the underwear.

2. The underwear garment of claim 1 wherein the cushion means consist of foam rubber.

3. The underwear garment of claim 1 or 2 wherein the means for securing the cushion means comprises a cloth placed over the cushion, said cloth being slightly larger than the cushion and sewn around its perimeter to the seat portion of the underwear.

4. The underwear garment of claim 1 or 2 wherein the means for securing the cushion means comprises a cloth placed over the cushion means, said cloth being sewn around its perimeter to the seat portion of the underwear and further being sewn again along a line parallel and interior to the first sew-line.

5. The underwear garment of claim 1 or 2 wherein the means for securing the cushion means comprises a cloth placed over the cushion means, said cloth being sewn around its perimeter to the seat portion of the underwear and further being sewn again along a line parallel and interior to the first sew-line and also sewn along a third sew-line down the middle of the seat portion to provide additional flexibility and comfort to the seat portion of the pants.

6. An underwear garment having a waistband and front and seat portions connected by a crotch portion with leg openings comprising:

cushion means in the seat and crotch portion extending from below the waistband to the bottom of the seat, from one side of the seat to the other and down to the leg openings; and means for securing the cushion means inside both the seat portion and crotch portion of the underwear.

7. The underwear garment of claim 6 wherein the cushion means consists of foam rubber.

8. The underwear garment of claim 6 or 7 wherein the means for securing the cushion means comprises a cloth placed over the cushion means, said cloth being sewn around its perimeter to the seat portion and crotch portion of the underwear.

9. The underwear garment of claim 6 or 7 wherein the means for securing the cushion means comprises a cloth placed over the cushion means, said cloth being sewn around its perimeter on the seat portion and crotch portion of the underwear and further being sewn again along a line parallel and interior to the first sew-line.

10. The underwear garment of claim 6 or 7 wherein the means for securing the cushion means comprises a cloth placed over the cushion means and sewn around its perimeter to the seat portion and crotch portion of the underwear and further being sewn again along a line parallel and interior to the first sew-line and sewn along a third sew-line down the middle of the seat portion to provide flexibility to the seat portion of the pants.

* * * * *